US007357369B2

(12) United States Patent
Noritake et al.

(10) Patent No.: US 7,357,369 B2
(45) Date of Patent: Apr. 15, 2008

(54) DAMPER DEVICE

(75) Inventors: Seiichiro Noritake, Nagano (JP); Hide Hara, Nagano (JP)

(73) Assignee: Nidec Sankyo Corporation, Nagano (JP)

( * ) Notice: Subject to any disclaimer, the term of this patent is extended or adjusted under 35 U.S.C. 154(b) by 513 days.

(21) Appl. No.: 10/936,609

(22) Filed: Sep. 8, 2004

(65) Prior Publication Data

US 2005/0076670 A1 Apr. 14, 2005

(30) Foreign Application Priority Data

Sep. 9, 2003 (JP) ..... 2003-317118

(51) Int. Cl.
*F16K 31/04* (2006.01)

(52) U.S. Cl. ..... 251/129.11; 251/298

(58) Field of Classification Search ..... 251/129.11, 251/129.12, 129.13, 298
See application file for complete search history.

(56) References Cited

U.S. PATENT DOCUMENTS

| | | | | |
|---|---|---|---|---|
| 5,174,546 | A * | 12/1992 | Giordani | 251/129.11 |
| 5,398,910 | A * | 3/1995 | Kitazawa | 251/129.11 |
| 5,417,235 | A * | 5/1995 | Wise et al. | 251/129.01 |
| 5,876,014 | A * | 3/1999 | Noritake et al. | 251/303 |
| 6,206,043 | B1 * | 3/2001 | Griswold et al. | 251/129.12 |
| 6,244,564 | B1 * | 6/2001 | Noritake | 251/129.11 |

FOREIGN PATENT DOCUMENTS

JP 09-264652 10/1997

* cited by examiner

*Primary Examiner*—John Bastianelli
(74) *Attorney, Agent, or Firm*—Reed Smith LLP

(57) ABSTRACT

A damper device includes a drive part, a baffle driven by the drive part, a frame including an aperture part which is opened or closed by the baffle, and a cover member for covering a joint part provided for the drive part to prevent moisture existing outside of the drive part from entering into the drive part. An adhesive is preferably coated in the joint part for the drive part to prevent the moisture from entering into the drive part.

4 Claims, 13 Drawing Sheets

【Fig.1】
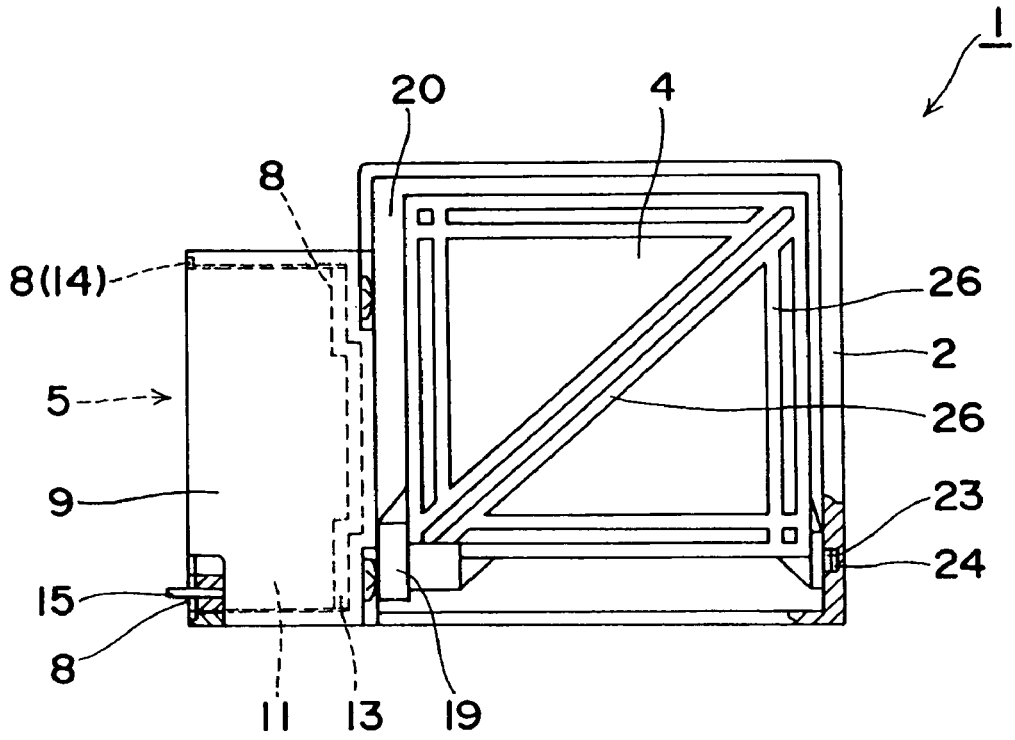

【Fig.2】
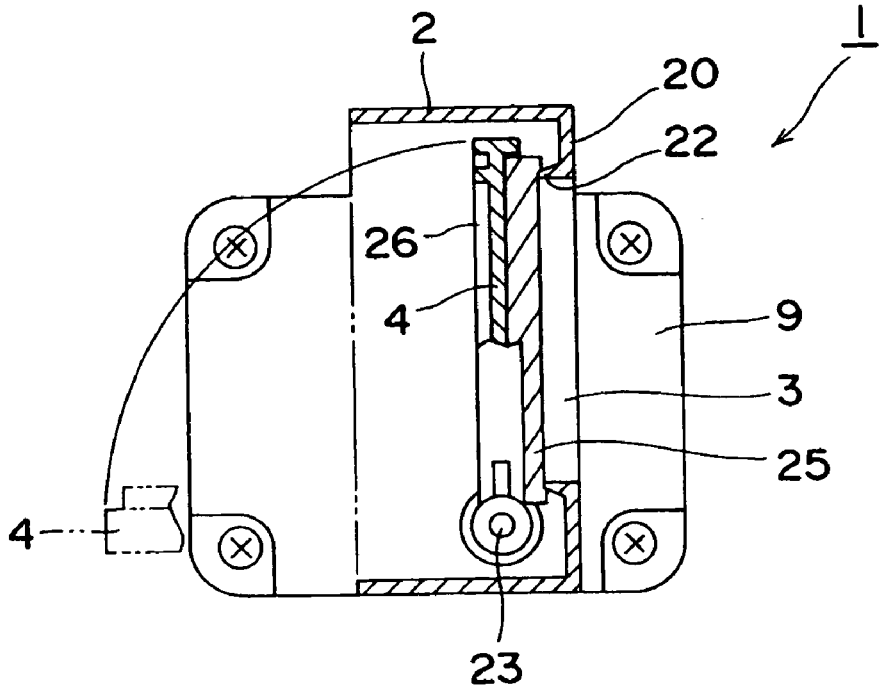

【Fig.3】
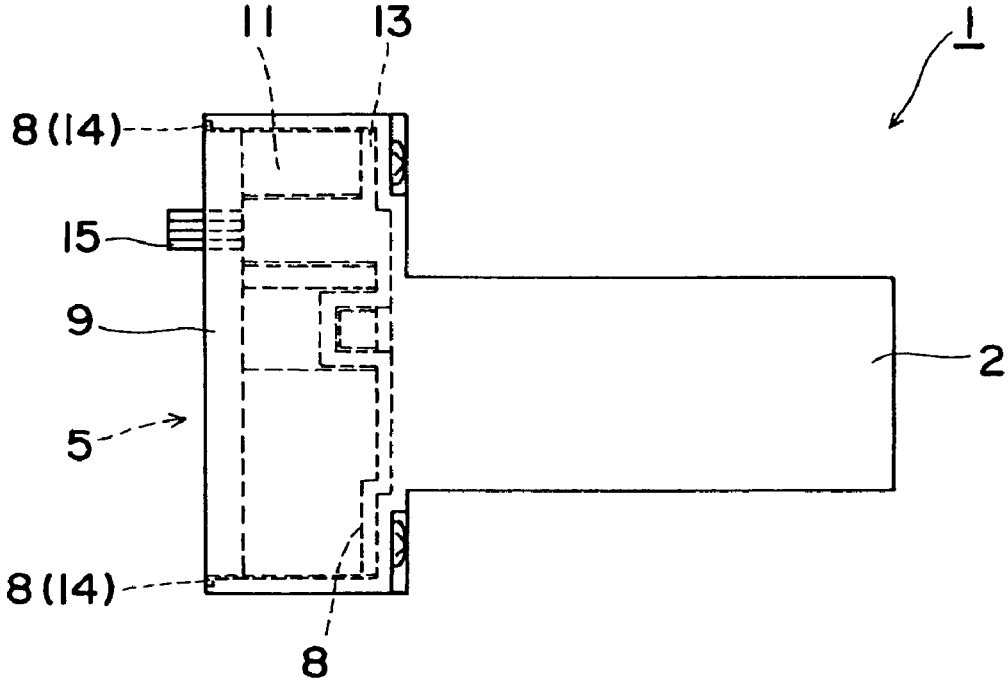

【Fig.4】
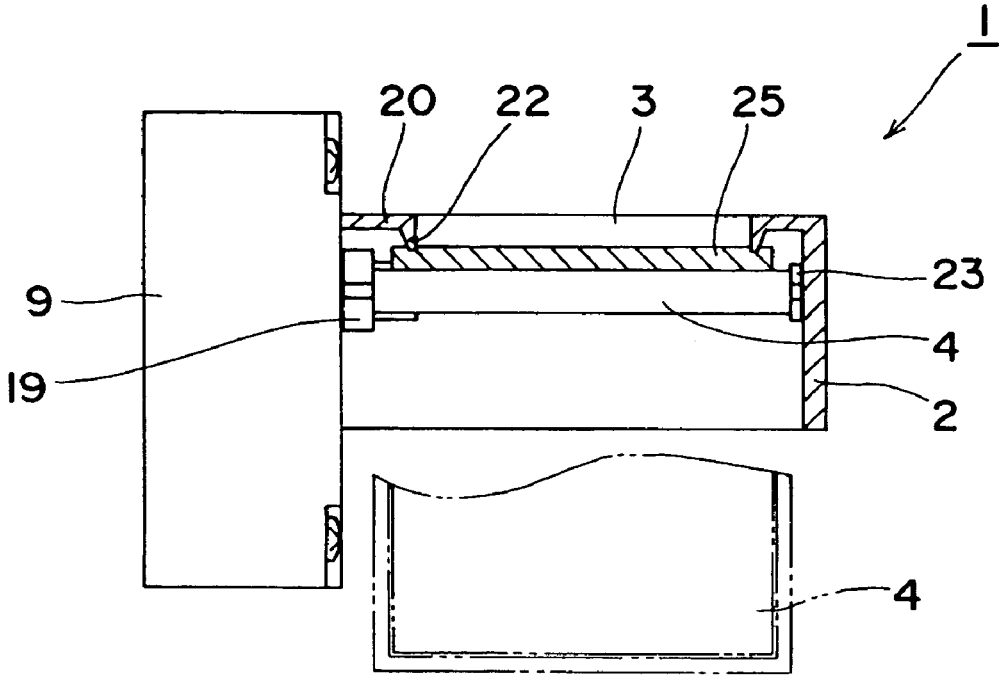

【Fig.5】
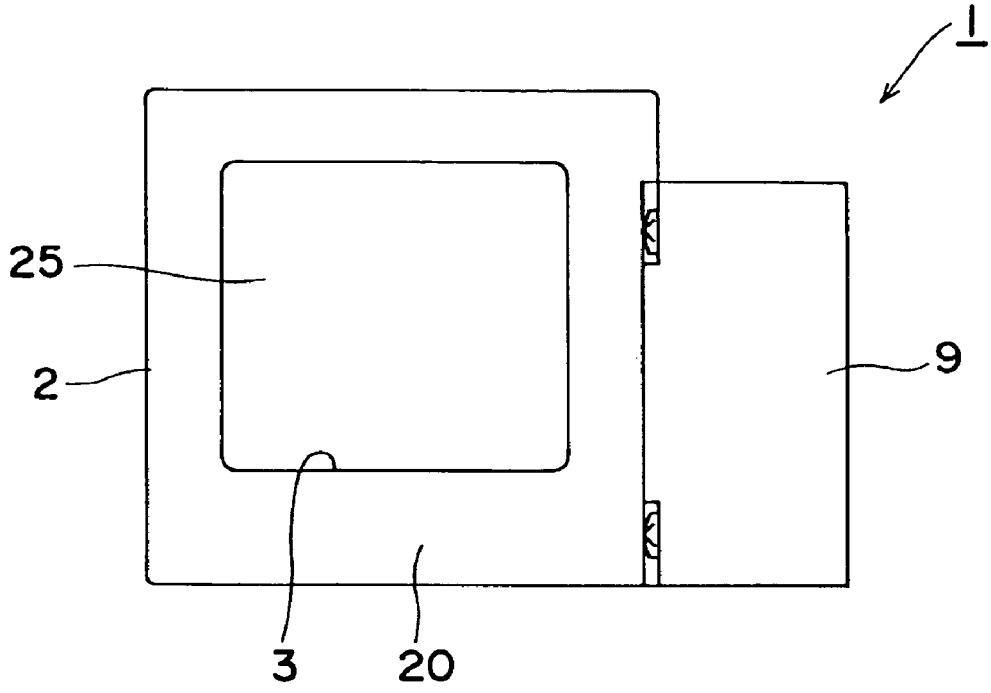

【Fig.6】
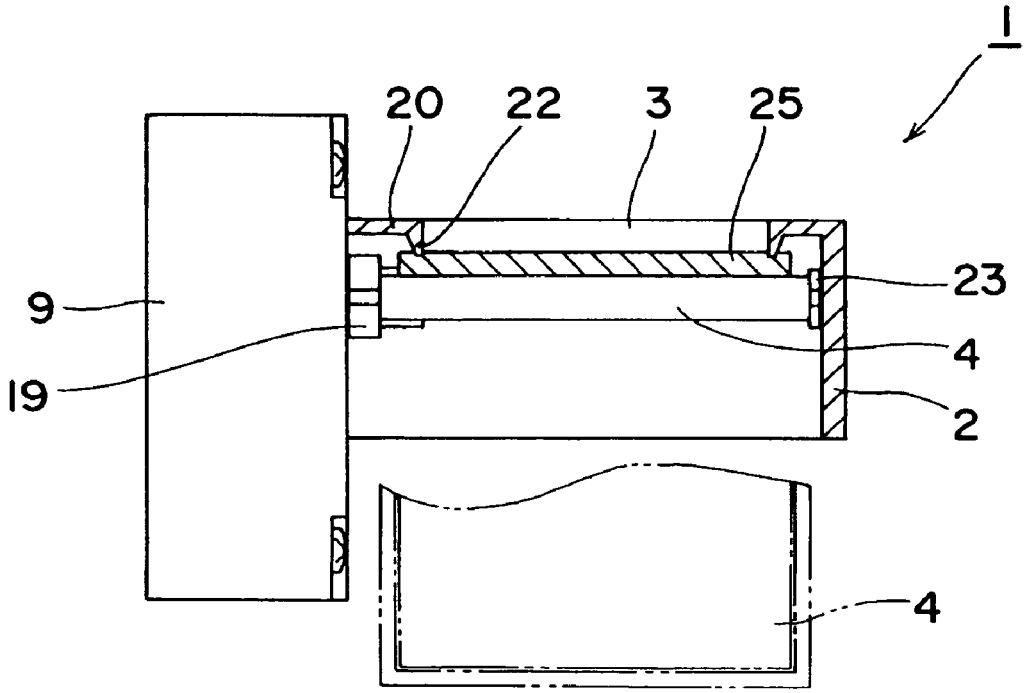

【Fig.7】
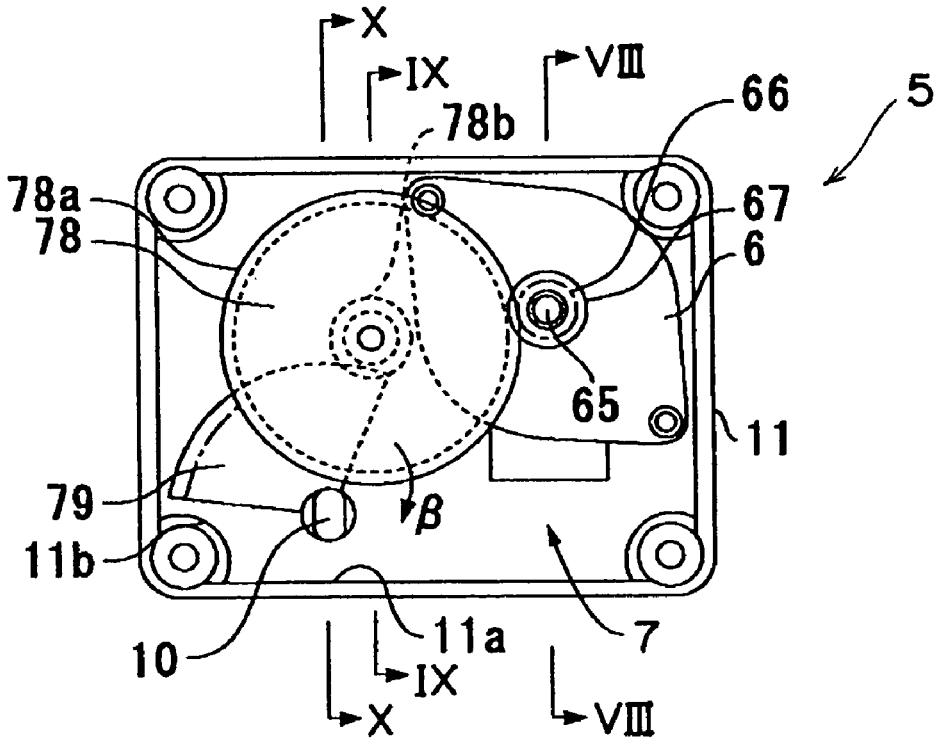

【Fig.8】
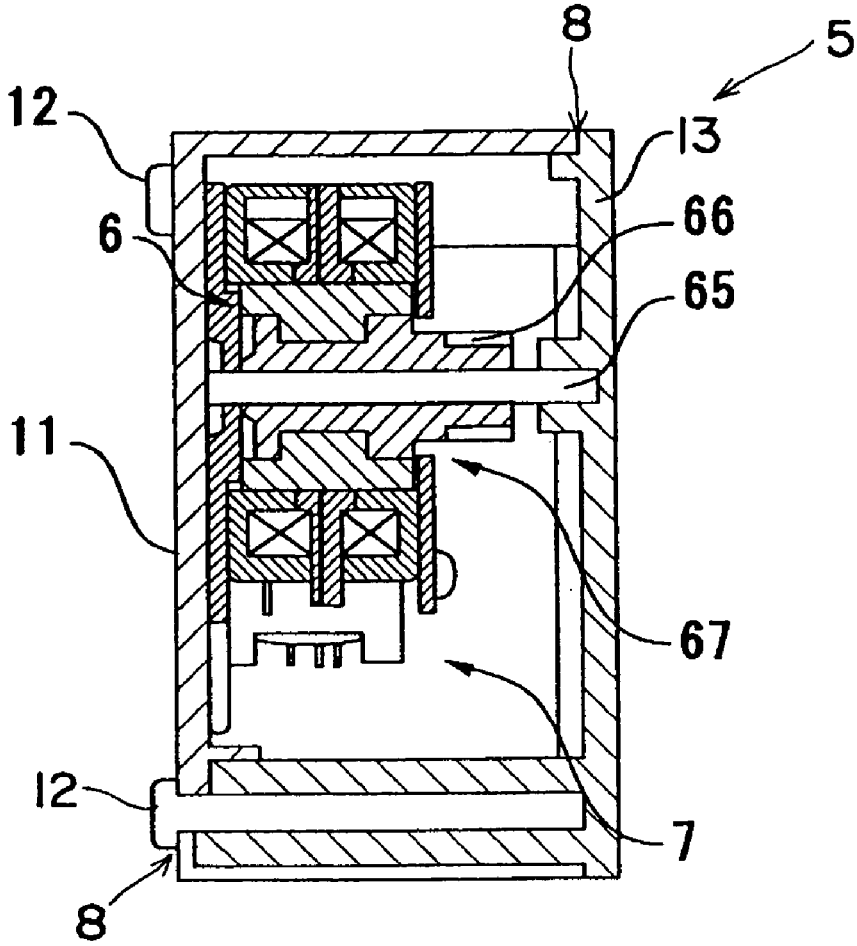

【Fig.9】
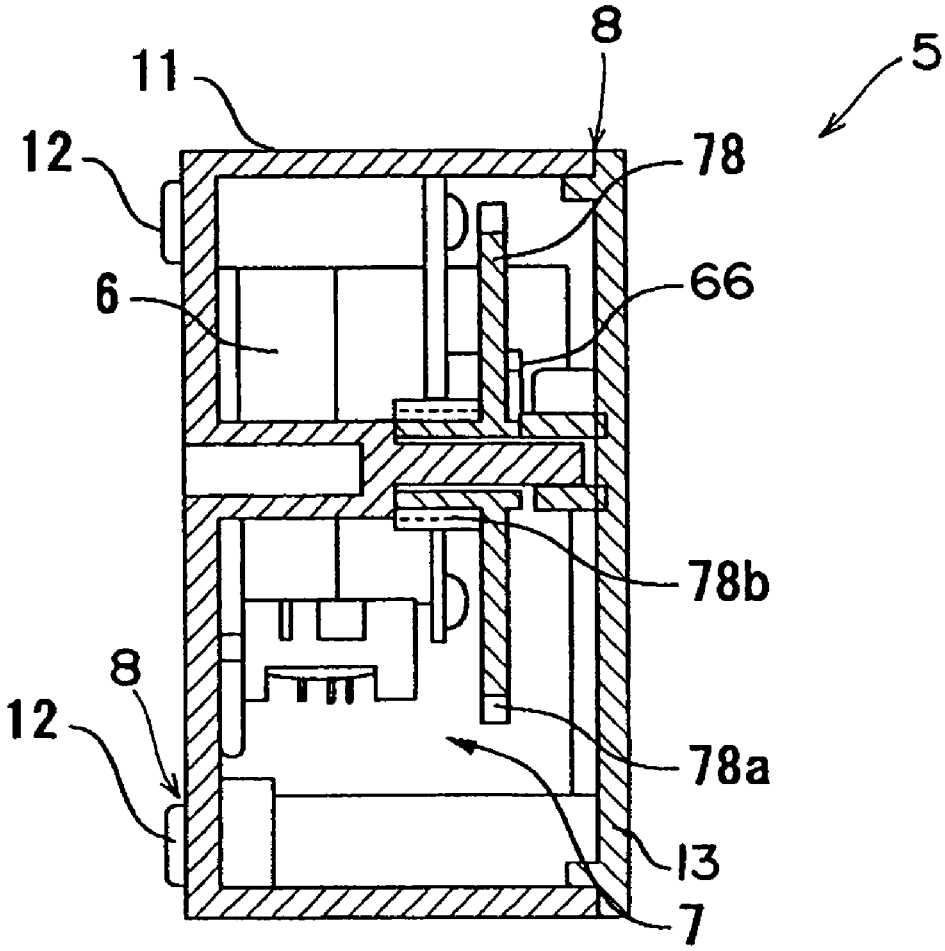

【Fig.10】
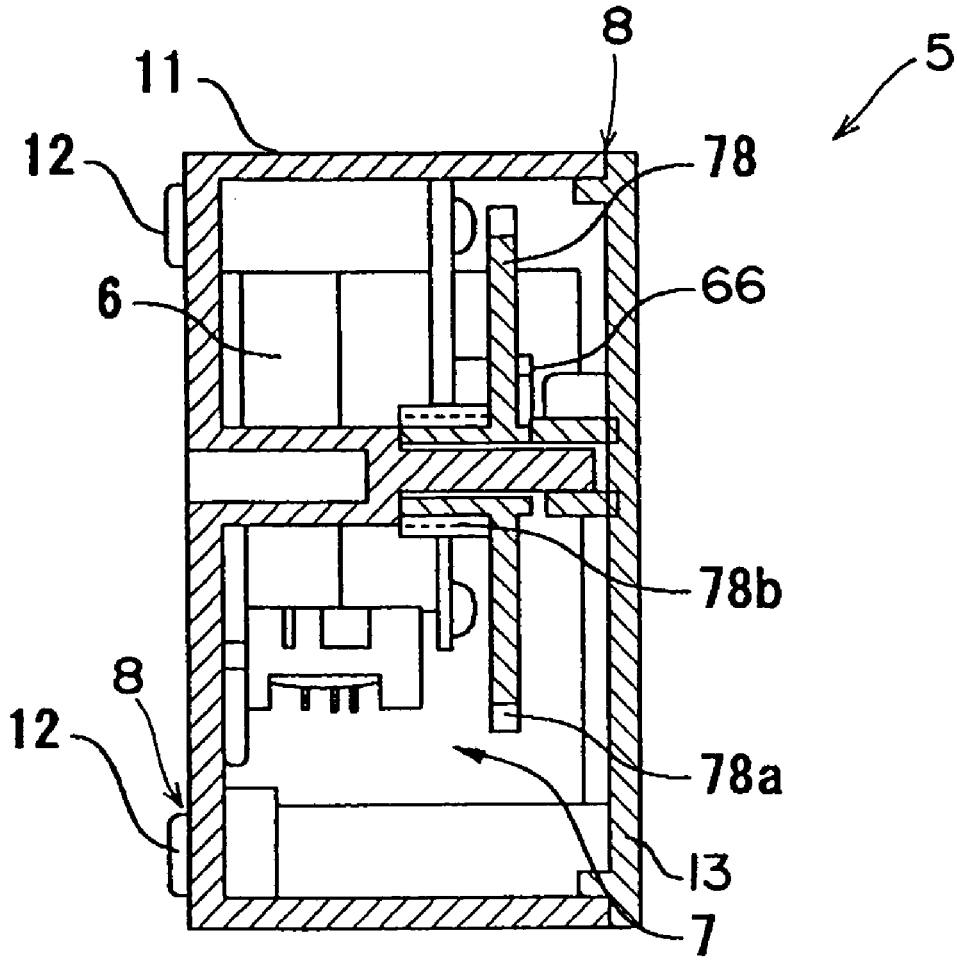

【Fig.11】
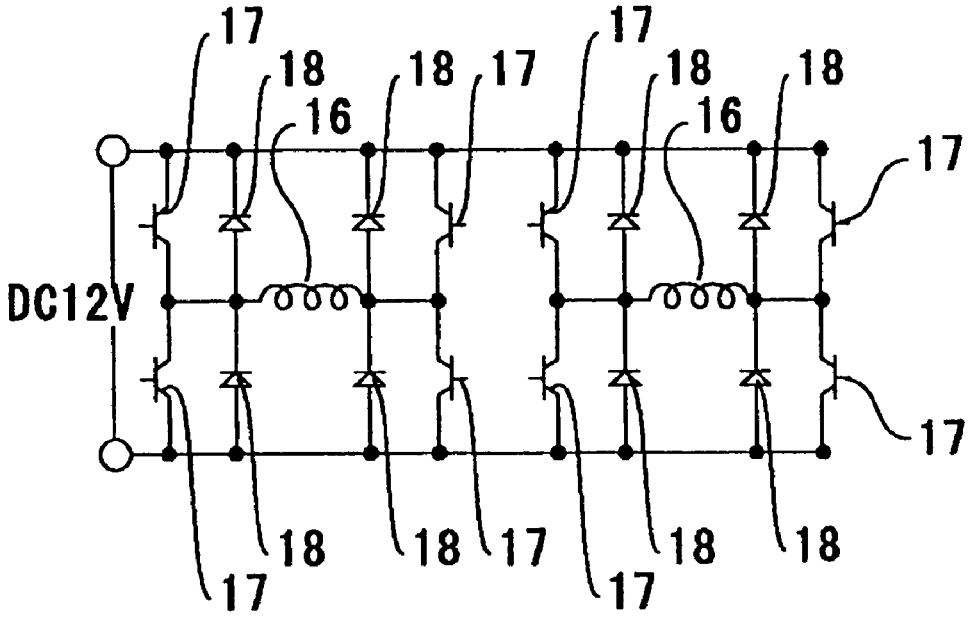

【Fig.12】
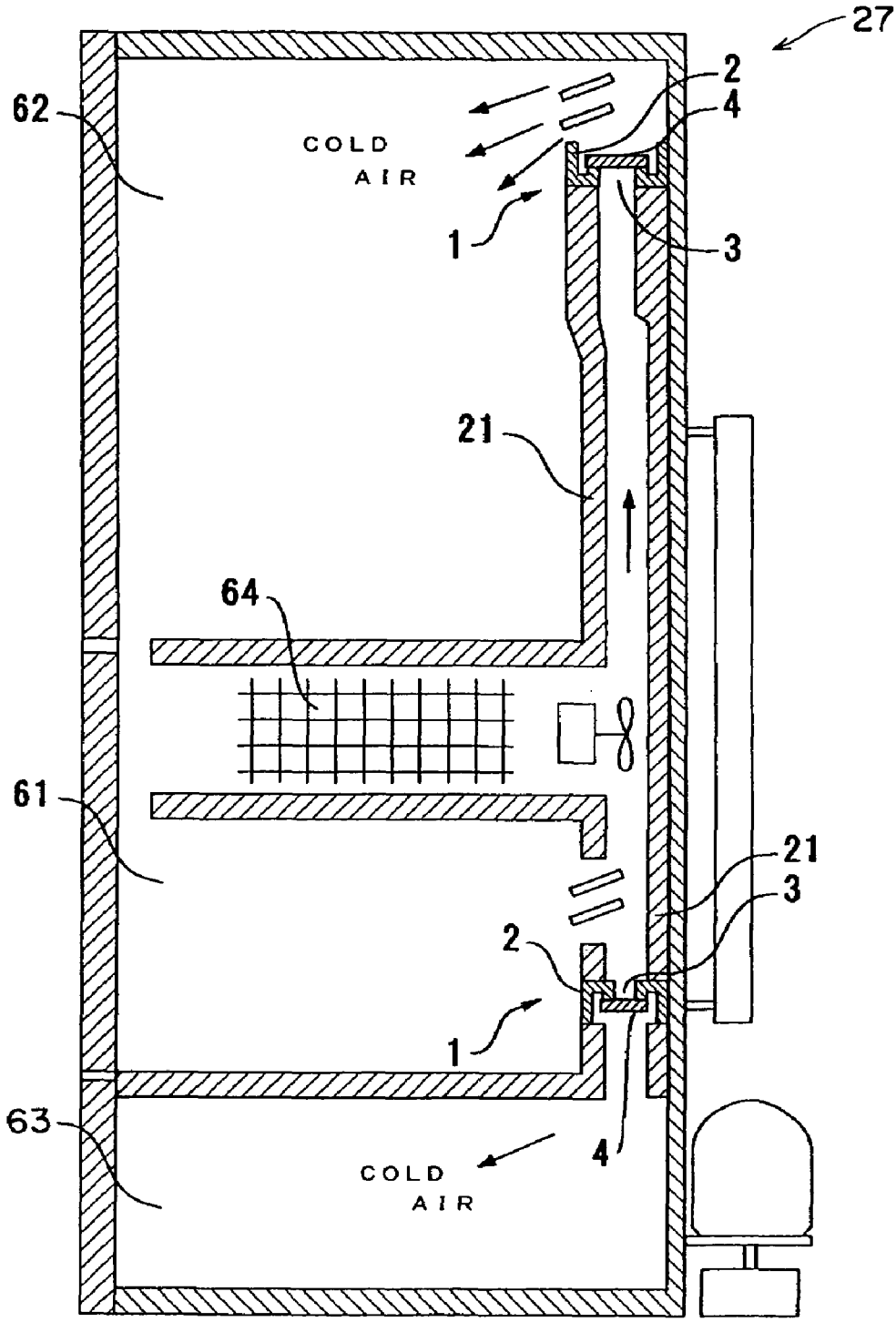

【Fig.13】
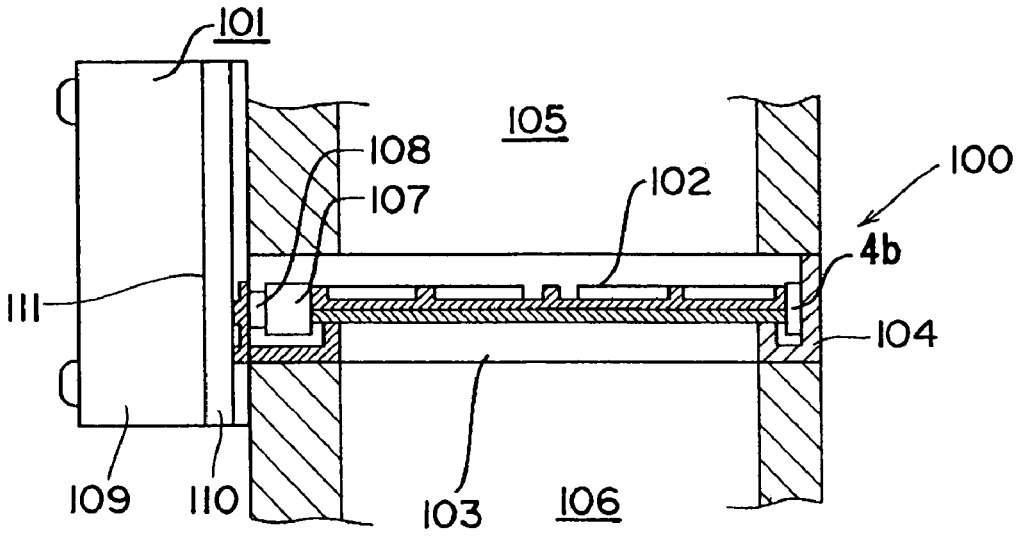

DAMPER DEVICE

CROSS-REFERENCE TO RELATED APPLICATIONS

This application claims priority to Japanese Application No. 2003-317118 filed Sep. 9, 2003, which is incorporated herein by reference.

FIELD OF THE INVENTION

The present invention relates to a damper device in which a baffle is opened and closed to an aperture part by a motor as a drive source. More specifically, the present invention relates to a damper device especially suitable for controlling the flow of cold air in a refrigerator.

BACKGROUND OF THE INVENTION

A damper device is installed in the flow passage of cold air to control the flow of the cold air in a refrigerator. An example of a conventional damper device 100 includes, as shown in FIG. 13, a drive part 101, a baffle 102 driven by the drive part 101, and a frame 104 forming an aperture part 103 which is opened or closed by the baffle 102 (see Japanese Patent Laid-Open No. Hei 09-264652).

The frame 104 and the baffle 102 are installed on the way of the flow passage of cold air from an evaporator to a refrigerating compartment to control the flow of the cold air by opening and closing the baffle 102. In other words, in the flow passages 105, 106 sandwiching the frame 104 and the baffle 102 between them, the flow passage 105 is in communication with the evaporator and the flow passage 106 is in communication with the refrigerating compartment.

The drive part 101 is disposed outside of the flow passages 105, 106. The drive part 101 includes a rotation shaft 108 connected to a shaft part 107 of the baffle 102 to turn the baffle 102, and a motor and a deceleration gear train for turning the rotation shaft 108. The motor and the deceleration gear train are built within a case 109 and a lid 110 of the drive part 101. The joint part 111 of the lid 110 and the case 109 is directly exposed to the cold air. The joint part of the case 109 and the draw-out port of a connector or a vinyl wire is also directly exposed to the cold air.

Since the flow passage 105 of the damper device 100 is in communication with the evaporator and the flow passage 106 is in communication with the refrigerating compartment, a temperature difference may occur around the damper device 100 and frost is easily formed on it. When the frost melts, moisture adheres on the periphery of the damper device 100.

However, in the damper device 100 described above, since the joint part 111 of the drive part 101 is exposed, the frost may melt and moisture enters into the inside of the drive part 101 from the joint part 111. When the moisture enters into the drive part 101, the moisture may freeze in the drive part 101 again which causes the gears to be locked because the frozen moisture is caught between the gears. Alternatively, the moisture may cause the metal disposed inside of the drive part 101 to rust, which may also result in the gears to be locked.

SUMMARY OF THE INVENTION

In view of the problems described above, it is an object and advantage of the present invention to provide a damper device capable of restricting moisture from entering the joint part of a drive part.

In order to achieve the above object and advantage, according to an embodiment of the present invention, there is provided a damper device including a drive part, a baffle driven by the drive part, a frame having an aperture part which is opened or closed by the baffle, and a cover member for covering a joint part provided in the drive part and for preventing moisture existing outside of the drive part from entering into the drive part. Therefore, since the joint part of the drive part is covered by the cover member, moisture is prevented from entering into the drive part from the joint part. This is true even in the case when frost melts and moisture adheres on the periphery of the damper device.

In accordance with an embodiment of the present invention, the frame and the cover member in the damper device are integrally formed by means of integral molding. According to the construction described above, moisture is prevented from entering into the drive part from the joint portion between the frame and the cover member.

Further, in order to achieve the above object and advantage, according to another embodiment of the present invention, there is provided a damper device including a drive part, a baffle driven by the drive part, a frame having an aperture part which is opened or closed by the baffle, and an adhesive coated in a joint part provided in the drive part and used to prevent moisture existing outside of the drive part from entering into the drive part. Therefore, since the joint part of the drive part is coated and sealed with the adhesive, moisture is prevented from entering into the drive part from the joint part thereof even when frost melts and moisture adheres on the periphery of the damper device.

In accordance with an embodiment of the present invention, the adhesive is preferably a silicon adhesive. According to the construction described above, since a strong adhesive force can be obtained even at a low temperature, the strength in sealing of the joint part of the drive part can be enhanced.

As described above, in the damper device in accordance with the embodiment of the present invention, since the joint part of the drive part is covered by the cover member, moisture is prevented from entering into the drive part from the joint part thereof even when frost melts and moisture adheres on the periphery of the damper device. As a result, re-freezing of moisture in the drive part, which causes to lock the drive mechanism, is prevented.

Further, in the damper device in accordance with the embodiment of the present invention, since moisture is prevented from entering into the drive part from the portion between the frame and the cover member, moisture is surely prevented from entering into the drive part.

In the damper device in accordance with the embodiment of the present invention, since the joint part for the drive part is coated and sealed with the adhesive, moisture is prevented from entering into the drive part from the joint part therefore even when frost may melt and moisture adheres on the periphery of the damper device. Consequently, the re-freezing of moisture in the drive part, which causes to lock the drive mechanism, is prevented.

Moreover, in the damper device in accordance with the embodiment of the present invention, since the adhesive is a silicon adhesive, a strong adhesive force can be obtained even at a low temperature. The strength in sealing in the joint part for the drive part can be enhanced and moisture is prevented from entering into the drive part from the joint part therefor.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

In the drawings:

FIG. 1 is a front view showing a damper device in accordance with an embodiment of the present invention;

FIG. 2 is a right side view showing the damper device shown in FIG. 1;

FIG. 3 is a bottom view showing the damper device shown in FIG. 1;

FIG. 4 is a plan view showing the damper device shown in FIG. 1;

FIG. 5 is a rear view showing the damper device shown in FIG. 1;

FIG. 6 is a left side view showing the damper device shown in FIG. 1;

FIG. 7 is a plan view showing an internal structure of a drive part;

FIG. 8 is a cross-sectional view showing the internal structure cut by the line of VIII-VIII in FIG. 7.

FIG. 9 is a cross-sectional view showing the internal structure cut by the line of IX-IX in FIG. 7;

FIG. 10 is a cross-sectional view showing the internal structure cut by the line of X-X in FIG. 7;

FIG. 11 is a circuit diagram for driving a stepping motor;

FIG. 12 is a longitudinal cross-sectional view showing a refrigerator installed with the damper device; and FIG. 13 is a plan view showing a conventional damper device.

DETAILED DESCRIPTION OF THE PREFERRED EMBODIMENTS

A damper device in accordance with an embodiment of the present invention will be described in detail below with reference to the accompanying drawings.

A damper device 1 in accordance with an embodiment of the present invention is shown in FIGS. 1 through 11. The damper device 1 includes a drive part 5, a baffle 4 driven by the drive part 5, and a frame 2 provided with an aperture part 3, which is opened or closed by the baffle 4. The damper device 1 is also provided with a cover member 9 which covers a joint part 8 formed in or with the drive part 5 as shown in FIGS. 1 through 6. The cover member 9 prevents moisture existing on the outside of the drive part 5 from entering the inside of it.

The frame 2 is made, for example, of an ABS resin molded product and formed in a tubular and rectangular shape. The cover member 9 is made, for example, of an ABS resin molded product and formed in a rectangular recessed shape where only one side is formed with an aperture part. The cover member 9 is attached to the frame 2 such that the recessed aperture part, to which the drive part 5 is fitted, faces the outside of the frame 2. In the embodiment of the present invention, the frame 2 and the cover member 9 are integrally molded. Therefore, moisture is prevented from entering into the drive part 5 between the frame 2 and the cover member 9.

The drive part 5 is fitted to the inside, i.e., the recessed aperture part of the cover member 9. The outer face of the drive part 5 is constructed with a motor case 11 and a motor lid 13. The entire motor case 11 and motor lid 13 of the drive part 5 are fitted into the aperture recessed part of the cover member 9 with an appropriate clearance between the drive part 5 and the cover member 9. An adhesive 14 is coated in the joint part 8 having the appropriate clearance between the edge portion of the aperture recessed part of the cover member 9 and the motor case 11 of the drive part 5. In other words, the damper device 1 is provided with the adhesive 14, which is coated to the joint part 8 for sealing the drive part 5. The adhesive 14 prevents moisture existing in the outside of the drive part 5 from entering in the inside of the drive part 5. In an embodiment of the present invention, the adhesive 14 is a silicon adhesive. Therefore, since a strong adhesive force can be obtained even at a low temperature, the joint part 8 for the drive part 5 can be assuredly sealed. Further, the cable 15 is drawn out from the drive part 5. As shown in FIG. 3, the adhesive 14 is coated in the joint part 8 of the periphery of the drawing-out portion of the cable 15. The clearance formed between the edge portion of the aperture recessed part of the cover member 9 and the motor case 11 of the drive part 5 is set to be an appropriate distance. This is because a wider distance may cause moisture to easily enter into the inside and a narrower distance may cause moisture to enter by the capillary phenomenon. Therefore, the clearance is preferably set to be an appropriate distance between the two distances.

The drive part 5 includes, as shown in FIGS. 7 through 10, a stepping motor 6 and a deceleration gear train 7 decelerating and transmitting the output of the stepping motor 6, which are built within the motor case 11 and the motor lid 13 of the drive part 5. The deceleration gear train 7 includes a pinion 66, a gear 78 and a sector gear 79.

The stepping motor 6 is provided with a fixed shaft 65. A rotor 67 having the pinion 66 is rotatably fitted to the fixed shaft 65. The pinion 66 meshes with teeth section 78*a* of the gear 78. The pinion section 78*b* of the gear 78 meshes with the sector gear 79. The sector gear 79 is turnably disposed about a rotational center shaft 10. Therefore, the rotation of the stepping motor 6 is decelerated by the deceleration gear train 7 and transmitted to the sector gear 79 to turn the rotational center shaft 10.

The shaft part 19 of the baffle 4 is fitted to the rotational center shaft 10 of the sector gear 79. An oval-shaped shaft inserted hole is formed on the shaft part 19 of the baffle 4 and fitted to the rotational center shaft 10 so as to turn in an integral manner. Therefore, the turning of the sector gear 79 can be transmitted to the shaft part 19 of the baffle 4. The baffle 4 turnably moves between a full opened position (shown by the two-dot chain line in the drawing) and a full closed position (shown by the solid line in the drawing) as shown in FIGS. 2 and 4 according to the turning of the rotational center shaft 10 to open or close the aperture part 3 of the frame 2.

The sector gear 79 turns less-than-one rotation while the baffle 4 changes the aperture part 3 from the full opened state to the full closed state. The opening angle of the sector gear 79 is set to be 110 degrees and the range of turning operation about the rotational center shaft 10 is set to be about 90 degrees. However, the range of turning operation is not limited to 90 degrees.

A side face part 11*a* of the motor case 11 is located ahead of a predetermined stop position of the sector gear 79 when the sector gear 79 is turned in an open direction as shown in FIG. 7. The side face part 11*a* prevents the sector gear 79 from further turning over the predetermined stop position. In addition, a screw seat part 11*b* of the motor case 11 is located ahead of a predetermined stop position of the sector gear 79 when the sector gear 79 is turned in a close direction. The screw seat part 11*b* prevents the sector gear 79 from further turning over the predetermined stop position.

A circuit for the stepping motor 6 includes two windings 16, eight transistors 17 and eight diodes 18 as shown in FIG. 11. The respective elements are symmetrically disposed so as to be bipolar driven. The stepping angle of the stepping motor 6 is set to be at 7.5 degree, the voltage of a power source is DC 12V, the use frequency is at 400 pps, the torque at the time of rotation is about 40 g·cm, and the detent torque is about 10 g·cm. The output of the stepping motor 6 is decelerated by the deceleration gear train 7 to one-twenty fifth (1/25). As a result, when the stepping motor 6 is used, the step angle of the rotational center shaft 10 is at 0.29 degrees, the output torque is about 1000 g·cm, and the stationary torque which is the torque that the position is held by the detent torque of the stepping motor 6 is about 250 g·cm. Further, the stepping motor 6 is controlled so that the maximum turning angle of the rotational center shaft 10 is about 90 degrees.

The frame 2 is provided with a flange part 20 protruding toward the inside of the aperture part 3 and a projected part 22 protruding in the direction of the aperture part 3 from the inside end part of the flange part 20 by integral molding as shown in FIGS. 2 and 4. The flange part 20 and the projected part 22 are formed over the entire periphery thereof. The inside of the projected part 22 is formed in the aperture part 3. The front end portion of the projected part 22 is brought into contact with the baffle 4. In the embodiment of the present invention, the flange part 20 and the projected part 22 are integrally formed with the frame 2 by the integral molding. However, they may be formed as a discrete member from the frame 2.

The baffle 4 is made of polycarbonate. The baffle 4 is rotatably fitted on one side thereof as the turning center. Shaft parts 19, 23 are formed at both end portions on one side of the baffle 4. The shaft part 19 is fitted to the rotational center shaft 10 of the drive part 5 and the shaft part 23 is rotatably supported by a support hole 24 formed in the frame 2 as shown in FIG. 1.

As shown in FIGS. 2 and 4, a cushion member 25 is provided on the surface of the baffle 4 on the aperture part 3 side. According to the construction described above, since the cushion member 25 abuts with the front end part of the projected part 22 and is bitten by the projected part 22 at the time of closing of the baffle 4, the air tightness can be enhanced. For example, soft tape made of foaming urethane may be used as the cushion member. However, the cushion member is not limited to just foaming urethane, the cushion member may be made of other elastic type materials such as foaming polyethylene or rubber. A rib 26 is formed on the rear face of the baffle 4 as shown in FIG. 1 and thus the strength of the baffle 4 is secured.

An embodiment in which the damper device 1 is assembled into a refrigerator 27 will be described below.

As shown in FIG. 12, the refrigerator 27 is constructed in the mid-freezer type and provided with an evaporator 64 at the middle section, a freezing compartment 61 under the evaporator 64, a vegetable compartment 63 under the freezing compartment 61, a refrigerating compartment 62 on the upper side of the evaporator 64, and a flow passage 21 for supplying cold air to the respective compartments 61 through 63 from the evaporator 64. The damper devices 1 are respectively provided at the inlet port of the flow passage 21 to the refrigerating compartment 62 and to the vegetable compartment 63. The frame 2 of the damper device 1 forms one part of the flow passage 21. In the embodiment of the present invention, the damper device 1 is installed for the refrigerating compartment 62 and the vegetable compartment 63. However, the present invention is not limited to the above-mentioned construction. For example, the damper device 1 may be installed only for the refrigerating compartment 62, or may be installed at the outlet port of the evaporator 64.

The operation of the damper device 1 and the refrigerator 27 in accordance with the present embodiment constructed above will be described below.

The damper device 1 controls the flow of cold air by opening and closing the aperture part 3 with the baffle 4. Since the difference of temperature easily occurs on the periphery of the damper device 1 and thus frost is easily formed, the frost may melt to cause moisture adhere to the periphery of the damper device 1. In the embodiment of the present invention, the joint part 8 of the motor case 11 and the motor lid 13 of the drive part 5 is covered with the cover member 9, and the joint part 8 of the drive part 5 and the cover member 9 and the joint part 8 of the motor case 11 and the cable 15 are sealed with the adhesive 14. Therefore, moisture is prevented from entering from the joint parts 8 described above.

A CPU or the like for performing the temperature control of the refrigerator 27 gives a command to the damper device 1 to flow cold air. As a result, the stepping motor 6 is driven and its rotation is transmitted to the baffle 4 via the pinion 66→gear 78→sector gear 79→rotational center shaft 10→shaft part 19. Therefore, the baffle 4 moves away from the projected part 22 and turns to an open position.

When the step number of the stepping motor 6 reaches to a prescribed number, for example, to 310 steps, the baffle 4 turns 90 degrees to be located at the full opened position and the stepping motor 6 is stopped. In this case, even when the stepping motor 6 does not stop due to the erroneous detection of the step number or the like, the sector gear 79 abuts with the side face part 11*a* of the motor case 11 and the further rotation of the sector gear 79 is prevented. Therefore, the baffle 4 does not turn excessively. The state of the full opened position is maintained by the self-holding force based on the current flow or the detent torque of the stepping motor 6. In the full opened position, since the cold air does not strongly hit the baffle 4, the force for holding the position of the baffle 4 is required to be small. The wind of the cold air in the refrigerator 27 gives a force of about 10 through 20 g, and on the other hand, the stationary torque of the rotational center shaft 10 due to the detent torque of the stepping motor 6 is about 250 g·cm. Therefore, the detent torque is enough to hold the position of the baffle 4 against the wind of the cold air.

In this state, when a target compartment supplied with cold air, for example, the refrigerating compartment 62, is cooled down and a command to close the baffle 4 is outputted, the stepping motor 6 is rotated in the reverse direction with respect to the case described above, the baffle 4 turns in the close direction. The position of the baffle 4 is detected by the number of pulses and, when a prescribed number of pulses, for example, 314 pulses are reached, the baffle 4 is determined to be at the full closed position and the stepping motor 6 is stopped.

In this case, after the cushion member 25 fixed on the baffle 4 abuts with the projected part 22, the stepping motor 6 further moves by four steps and then stops. In other words, the number of steps when the baffle 4 comes into contact with the projected part 22 is 310, but the stepping motor 6 is further driven by four steps after the baffle 4 has contacted with the projected part 22. Such added number of steps may be needed only at least one pulse, but it is preferable to add about one through seven pulses, that is, in the range of over zero degree but not more than two degrees in the angle of the rotational center shaft 10. The added number of steps may be set to be more than eight, but a fewer number is preferable because a lock noise may possibly occur.

According to the damper device 1 described above, since the stepping motor 6 is further driven after the baffle 4 has brought into contact with the projected part 22, the torque of the stepping motor 6 is applied to the baffle 4 and the cushion member 25 having an elastic force is pressed such that the projected part 22 is bitten into the cushion member 25 and thus the baffle 4 tightly comes into contact with the projected part 22 without clearance. In this case, when the protruding length of the projected part 22 or the shape of the baffle 4 is dispersed, or the gear 78 or the like includes a backlash, a tight contact may not be completely performed. However, in the embodiment of the present invention, since the stepping motor 6 is continued to be driven after the cushion member 25 contacts with the projected part 22, the projected part 22 is bitten into the cushion member 25 and the baffle 4 can completely close without clearance.

When the power supply to the stepping motor 6 stops, the resilient force of the cushion member 25 is transmitted to the gear part of the sector gear 79, the gear 78 or the like and the rotor 67 through the rotation center shaft 10. However, since the stepping motor 6 has the detent torque, the rotor 67 will not be easily rotated. Therefore, the backlash of the gear 78 is eliminated and the looseness is prevented in the transmission mechanism from the rotor 67 of the stepping motor 6 to the baffle 4. Moreover, the detent torque of the stepping motor 6 becomes to be a large value, i.e., about 250 g·cm at the position of the center shaft 10 in the embodiment of the present invention and thus the baffle 4 is maintained at the full closed position.

According to the embodiment of the present invention, even when the stepping motor 6 does not stop in the predetermined position by erroneous detection of the number of steps at the time of closing operation, excessive rotation of the rotation center shaft 10 and the baffle 4 is prevented because the sector gear 79 abuts against the screw seat part 11*b* of the motor case 11. Therefore, the projected part 22 can be avoided to bite excessively into the cushion member 25 of the baffle 4. Since excessive deformation of the cushion member 25 can be prevented, the cushion member 25 returns to the original state even if the baffle 4 repeats the open and close operation and thus a high degree of closeness can be maintained for a long time used period.

The screw seat part 11*b* makes the baffle 4 stop at the position where the baffle 4 moves in the further closed direction than that where the baffle 4 makes the aperture part 3 in the full closed state. Consequently, the stopper mechanism using the screw seat part 11*b* functions only as a safety and does not operate at the time of a normal state. As a result, at the time of the baffle 4 being closed, the impact sound can be avoided, which occurs only when the sector gear 79 abuts against the screw seat part 11*b*.

When the baffle 4 is to be stopped at a position, which is not at the full closed position, for example, an intermediate position between the full opened position and the full closed position, firstly the baffle 4 may be moved in the full closed position to return to the home position. Then, the stepping motor 6 is driven by the number of steps which is smaller than that required for the full opened position from the home position.

The present invention has been described in detail using the embodiments, but the present invention is not limited to the embodiments described above and many modifications can be made without departing from the present invention. For example, in the present embodiment of the present invention, the frame 2 and the cover member 9 are integrally formed by integral molding. However, the present invention is not limited to the above-mentioned embodiment and the frame 2 and the cover member 9 may be separately formed.

Further, in the above-mentioned embodiment, the adhesive 14 is coated in the joint part 8 of the drive part 5 and the cover member 9 and in the joint part 8 of the motor case 11 and the cable 15. However, the present invention is not limited to the construction described above. For example, as shown in FIGS. 8 through 10, when the bolts 12 for fixing the motor case 11 to the motor lid 13 are exposed, the adhesive 14 may be coated to the joint part 8 of the motor case 11 and the bolt 12. In addition, in the above-mentioned embodiment, the adhesive 14 is not coated to the joint part 8 of the motor case 11 and the motor lid 13 of the drive part 5. However, the adhesive 14 may be coated there. Further, in the above-mentioned embodiment, the silicon adhesive 14 is used for the adhesive 14 but other adhesives 14 may be used.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A damper device comprising:

a drive part comprising:

a motor and a deceleration gear train; and a case and a lid;

wherein with which an outer face of the drive part is constructed the case and the lid; and wherein the case and the lid accommodate the motor and the deceleration gear train;

a baffle which is driven by the motor through the deceleration gear train;

a frame including a first aperture part which is opened or closed by the baffle; and a cover member which accommodates the drive part;

wherein the cover member is formed with an tubular aperture recessed part;

wherein the tubular aperture recessed part is formed so that only one side of the tubular aperture recessed part, in a shaft direction of the baffle, is opened as a second aperture part;

wherein the second aperture part accommodates the case and the lid of the drive part;

wherein the case and the lid of the drive part are fitted into and accommodated within the tubular aperture recessed part of the cover member so that a joint part between the case and the lid is located within the tubular aperture recessed part and surrounded by the cover member to prevent moisture existing outside of the drive part from entering into the drive part through the joint part between the case and the lid, and wherein an adhesive is coated between an edge portion of the aperture recessed part of the cover member and the case of the drive part, so as to prevent moisture located outside of the cover member from entering into a gap between the cover member and the case of the drive part.

2. The damper device according to claim 1, wherein the frame and the cover member are integrally formed by means of integral molding.

3. The damper device according to claim 1, wherein the adhesive is a silicon adhesive.

4. The damper device according to claim 1, wherein an adhesive is coated in a joint part provided for the drive part to prevent moisture existing outside of the drive part from entering into the drive part.

* * * * *